US007077701B2

(12) United States Patent
Martin

(10) Patent No.: US 7,077,701 B2
(45) Date of Patent: Jul. 18, 2006

(54) SEALED ELECTRICAL CONNECTOR

(75) Inventor: Galen Monroe Martin, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 27 days.

(21) Appl. No.: 10/456,297

(22) Filed: Jun. 6, 2003

(65) Prior Publication Data

US 2004/0248449 A1 Dec. 9, 2004

(51) Int. Cl.
*H01R 13/40* (2006.01)

(52) U.S. Cl. ..... 439/595

(58) Field of Classification Search ..... 439/595, 439/274, 275, 587, 589
See application file for complete search history.

(56) References Cited

U.S. PATENT DOCUMENTS 4,714,437 A * 12/1987 Dyki ..... 439/595
4,776,813 A * 10/1988 Wilson et al. ..... 439/587
4,900,271 A * 2/1990 Colleran et al. ..... 439/595
5,618,198 A * 4/1997 Sato et al. ..... 439/274
6,200,164 B1 * 3/2001 Martin et al. ..... 439/595
6,599,150 B1 * 7/2003 Martin et al. ..... 439/595

FOREIGN PATENT DOCUMENTS

EP 1 045 482 A2 10/2000
GB 2 245 777 A 1/1992

* cited by examiner

*Primary Examiner*—Phuong Dinh

(57) ABSTRACT

A sealed electrical connector includes a housing having a mating end and a wire receiving end. The wire receiving end is configured to receive a terminal joined to a wire. A cover is provided on the wire receiving end of the housing. The cover includes a terminal position assurance (TPA) element that extends from the cover through the wire receiving end and into the housing. The TPA engages the housing to prevent movement of the cover to a closed position until the terminal is fully loaded through the wire receiving end of the housing. The connector also includes a seal held between the housing and cover to seal the terminal receiving end when the cover is in the closed position. The connector further includes a terminal retention device to retain a terminal contact when the contact is fully loaded in the connector.

19 Claims, 7 Drawing Sheets

SEALED ELECTRICAL CONNECTOR

BACKGROUND OF THE INVENTION

This invention relates generally to electrical connectors and more particularly to a sealed electrical connector.

Sealed electrical connectors are used in many areas, such as in the automotive industry and in outdoors commercial fields, to protect electrical connections from moisture or other contaminants. In today's vehicles, there are many systems, particularly vehicle safety and control systems, such as brake or wheel speed sensors, exterior lighting assemblies, fuel injector connections, and other engine compartment applications that utilize electrical connectors in environments where it is desirable to protect the internal contacts of the connector from contamination.

Typically, conventional sealed connectors require several component parts to form a completed connector, particularly when the connector is combined with other features, such as terminal position assurance (TPA) and terminal retention. This is both inconvenient and costly as the seals, retainers, TPA members, and other components may be lost or damaged during initial assembly or when service operations are performed.

A need exists for a sealed connector that, among other things, is less complex, more reliable and less costly to produce.

BRIEF DESCRIPTION OF THE INVENTION

In one embodiment of the invention, a connector includes a housing having a mating end and a wire receiving end. The wire receiving end is configured to receive a terminal joined to a wire. A cover is provided on the wire receiving end of the housing. The cover includes a terminal position assurance (TPA) element that extends from the cover through the wire receiving end and into the housing. The TPA engages the housing to prevent movement of the cover to a closed position until the terminal is fully loaded through the wire receiving end of the housing. The connector also includes a seal held between the housing and cover to seal the terminal receiving end when the cover is in the closed position.

In another embodiment of the invention, a connector includes a housing having a body that has a mating end and a wire receiving end. The body has a cavity configured to receive a terminal through the wire receiving end. A terminal retention element is configured to retain a terminal in the cavity. A cover is provided on the wire receiving end of the body. The cover includes a terminal position assurance (TPA) element extending from the cover through the wire receiving end into the body. The TPA engages the body to prevent movement of the cover to a closed position until the terminal and wire are fully loaded through the wire receiving end. The connector also includes a seal held between the housing and cover to seal the terminal receiving end when the cover is in the closed position.

DETAILED DESCRIPTION OF THE INVENTION

Figure 1:
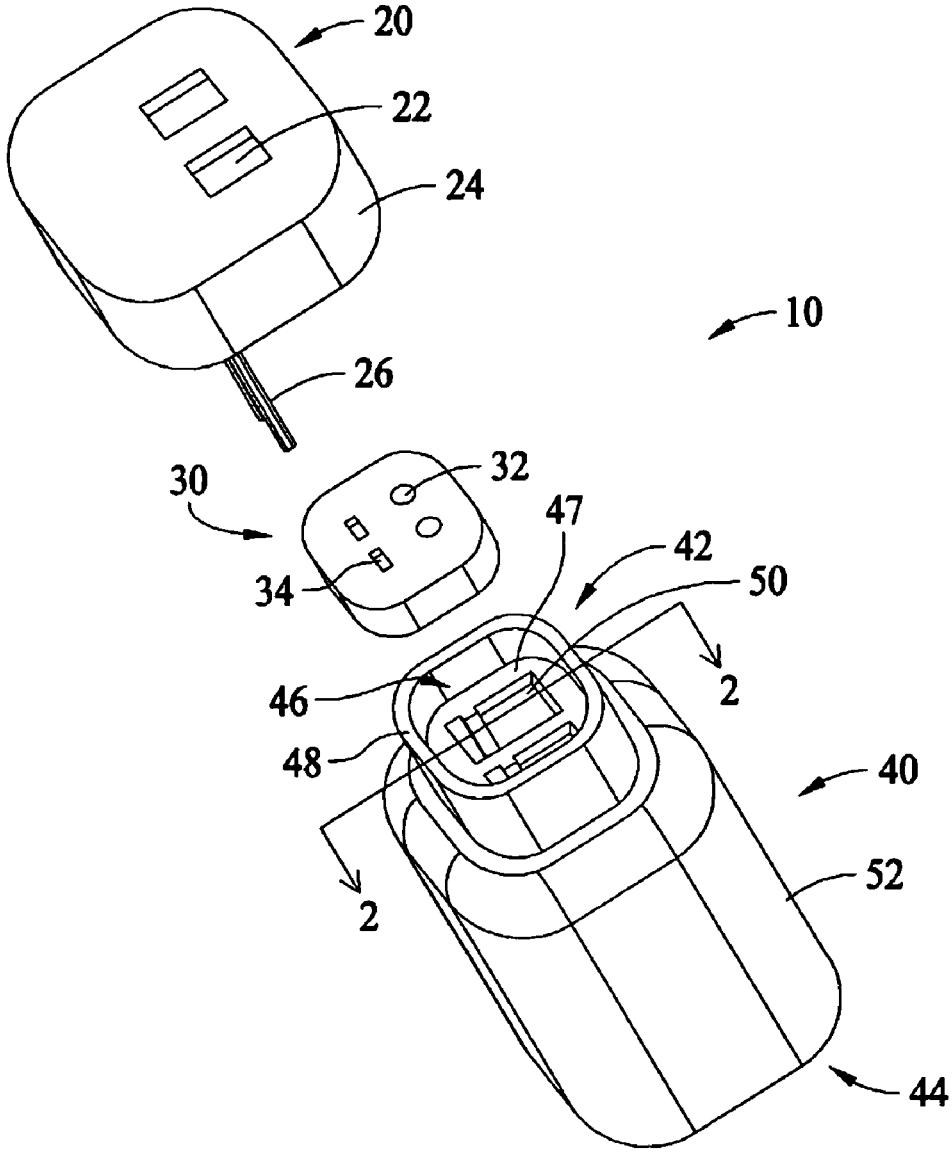
FIG. 1 is an exploded perspective view of one embodiment of a sealed connector.

FIG. 1 illustrates an exploded view in perspective of a connector 10. The connector 10 is a two-terminal connector; however, in other embodiments, any number of terminals may be present. The connector 10 includes a cover 20, a seal 30, and a housing 40. The cover 20 includes contact openings 22, which extend through the cover 20, and a rim 24. Terminal position assurance (TPA) elements 26 are attached to the underside of the cover 20 and extend outwardly therefrom. Seal 30 includes contact openings 32 and TPA element openings 34. The seal 30 is a mat seal that can be constructed of any material commonly used for sealing purposes, such as silicone rubber. The housing 40 includes a wire receiving end 42 and a mating end 44. In one embodiment of the connector 10, wire receiving end 42 and mating end 44 oppose each other along a common axis. Alternatively, the connector 10 may be angled so that wire receiving end 42 and mating end 44 are formed on adjacent sides of the housing 40. Housing 40 also includes a seal cavity 46 surrounded by a seal retaining wall 48. The seal 30 is received in the seal cavity 46 in the assembled connector 10. Housing 40 also includes contact entryways 50 at the base 47 of seal cavity 46 at the wire receiving end 42. A shroud 52 forms the outer shell of the housing 40.

Figure 2:
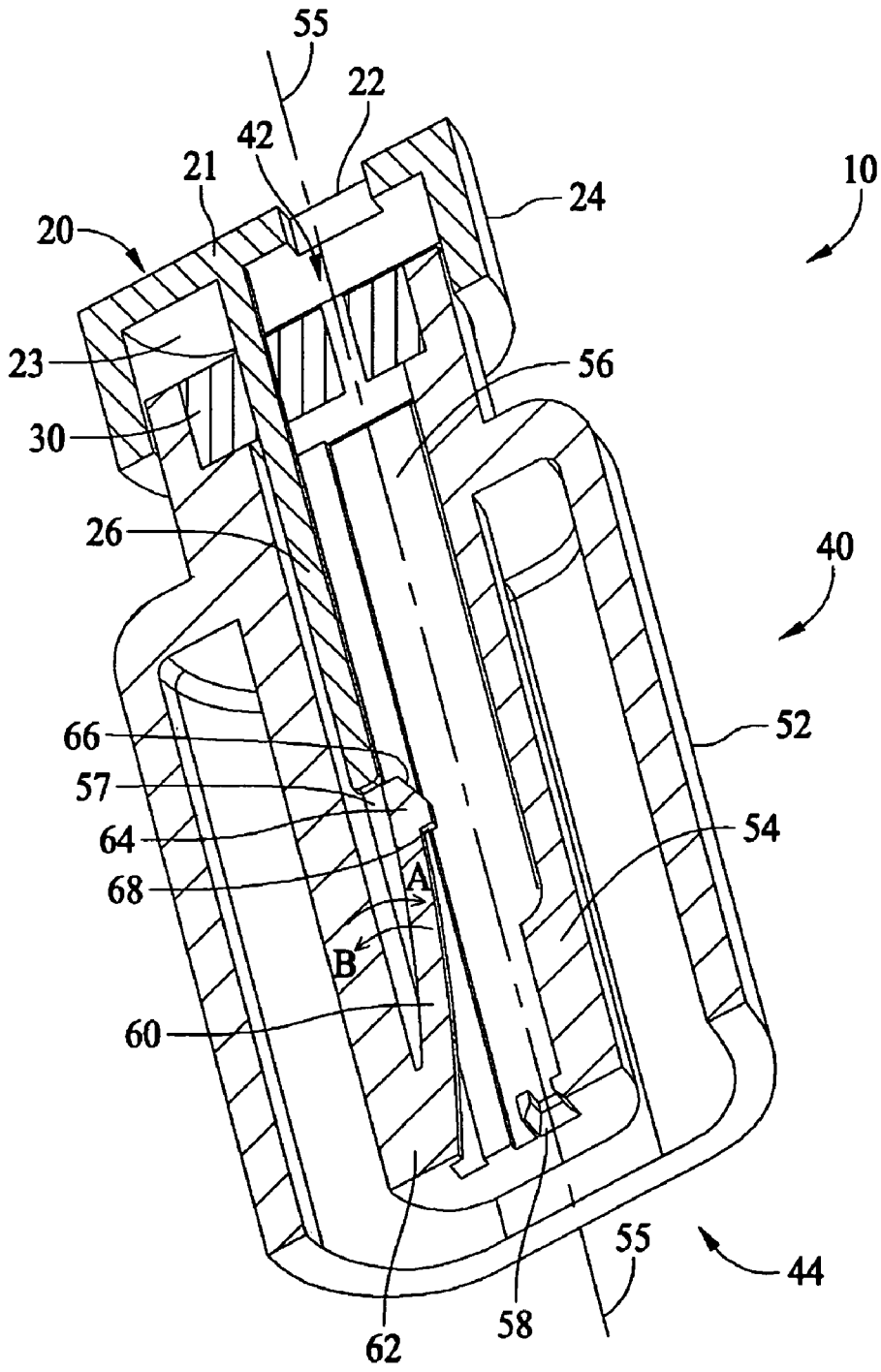
FIG. 2 is a cross-sectional view in perspective of the connector of FIG. 1 taken through the plane 2—2 in FIG. 1 with the connector in an initial staged condition.

FIG. 2 illustrates a cross section of the connector 10 taken through the plane 2—2 in FIG. 1. The cover 20 includes a base 21 formed integrally with the rim 24. The base 21 includes an interior surface 23 from which the TPA 26 extends. The TPA is formed integrally with the base 21 and oriented perpendicular to surface 23. In FIG. 2, the connector 10 is shown in an initial staged position with the seal 30 seated in the seal cavity 46 and with the cover 20 positioned over the wire receiving end 42 of the housing 40, but not seated. In FIG. 2, internal detail of the housing 40 is shown, which includes a connector body 54 that surrounds and defines a contact cavity 56 and a TPA channel 57. The contact cavity 56 extends substantially through the entire length of the body 54 along a terminal loading axis 55 from the wire receiving end 42 to the mating end 44 of the connector 10. The cavity 56 culminates at the mating end 44 with an opening 58, which is provided in body 54 for receiving a mating terminal (not shown).

The housing 40 also includes a terminal retention member 60 having one end formed with of the body 54 proximate the mating end 44 at junction 62. The terminal retention member 60 is joined to the body 54 at a juncture 62 and extends from the juncture 62 towards the wire receiving end 42 of the housing 40. The terminal retention member 60 has a contact latch 64 directed toward the wire receiving end 42 that includes a beveled surface 66 and a latch face 68. The terminal retention member 60 is a deflectable beam that is movable at the juncture 62 toward the contact cavity 56 in the direction of arrow A and away from the contact cavity 56 in the direction of arrow B. The terminal retention member 60 is biased such that the contact latch 64 extends into the contact cavity 56 in connector body 54. When a contact (not shown in FIG. 2) is inserted into the contact cavity 56 the contact engages the beveled surface 66 of the contact latch 64 thereby deflecting the terminal retention member 60 into the TPA channel 57. When the terminal retention member 60 moves into the TPA channel 57, as explained below, it blocks the travel of TPA element 26. Upon complete insertion of the contact, the contact latch 64 snaps back to its biased position which is in an interfering relation with the contact cavity 56 at which the latch face 68 engages the contact to hold the contact within the contact cavity 56.

Figure 3:
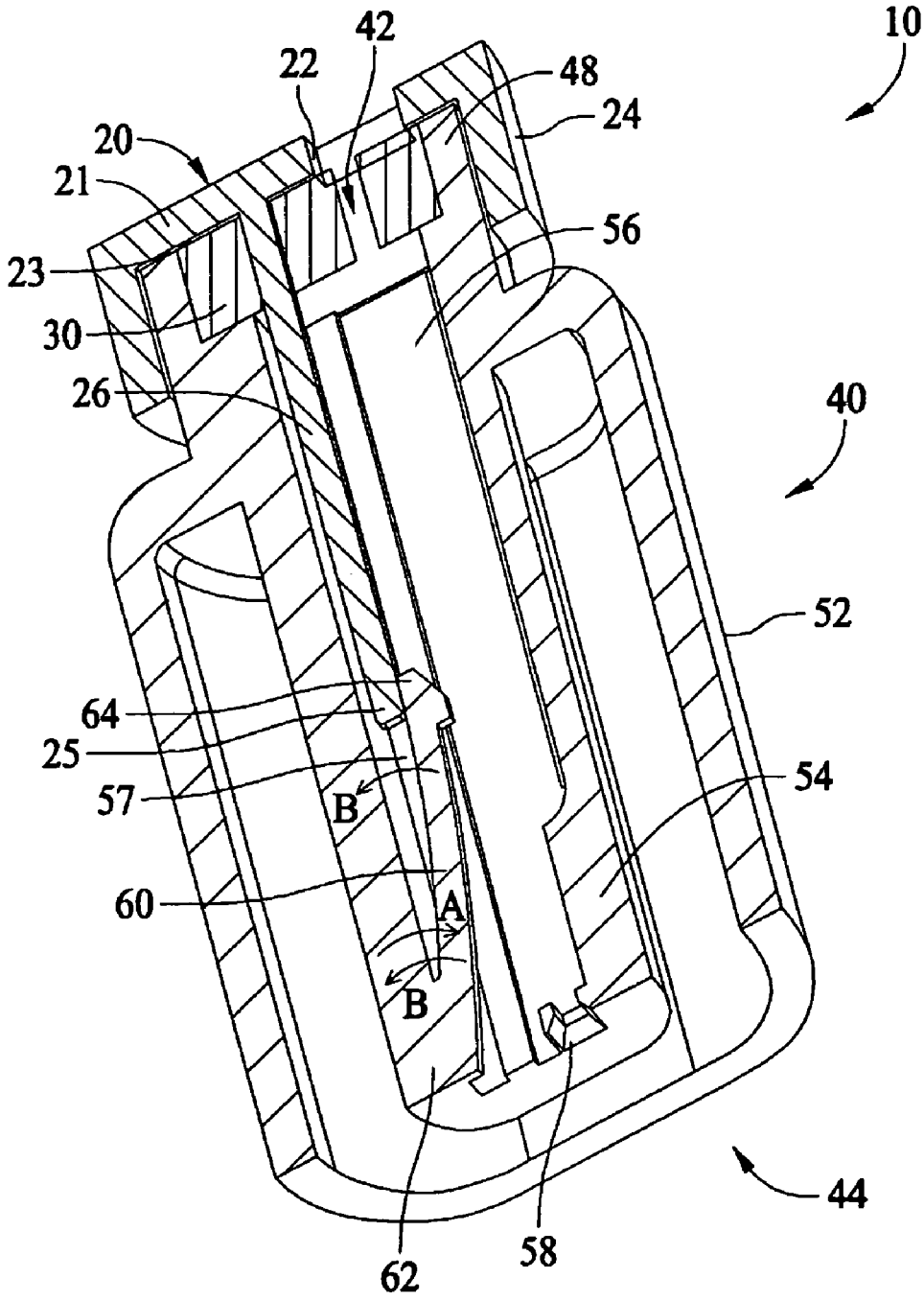
FIG. 3 is a side cross-sectional view in perspective of the connector of FIG. 1 taken through the plane 2—2 with the connector in a final seated condition.

FIG. 3 is a cross section of the connector 10 taken through the plane 2—2 of FIG. 1 illustrating the connector 10 in a final seated position and showing the operation of the TPA element 26. As illustrated in FIG. 3, the cover 20 is seated on the wire receiving end 42 of the housing 40 with the rim 24 over the seal wall 48. Optionally, the rim 24 may be sized to fit inside the wire receiving end 42 or, the cover 20 may not include a rim 24 instead press flushly against the end of the housing 40. The TPA element 26 is shown extending into the TPA channel 27 of the connector body 54 such that an outer end 25 of the TPA element 26 inhibits movement of the contact latch 64 in the direction of arrow B away from the contact cavity 56.

The operation of the connector 10 will now be described with reference to FIGS. 4 through 7.

Figure 4:
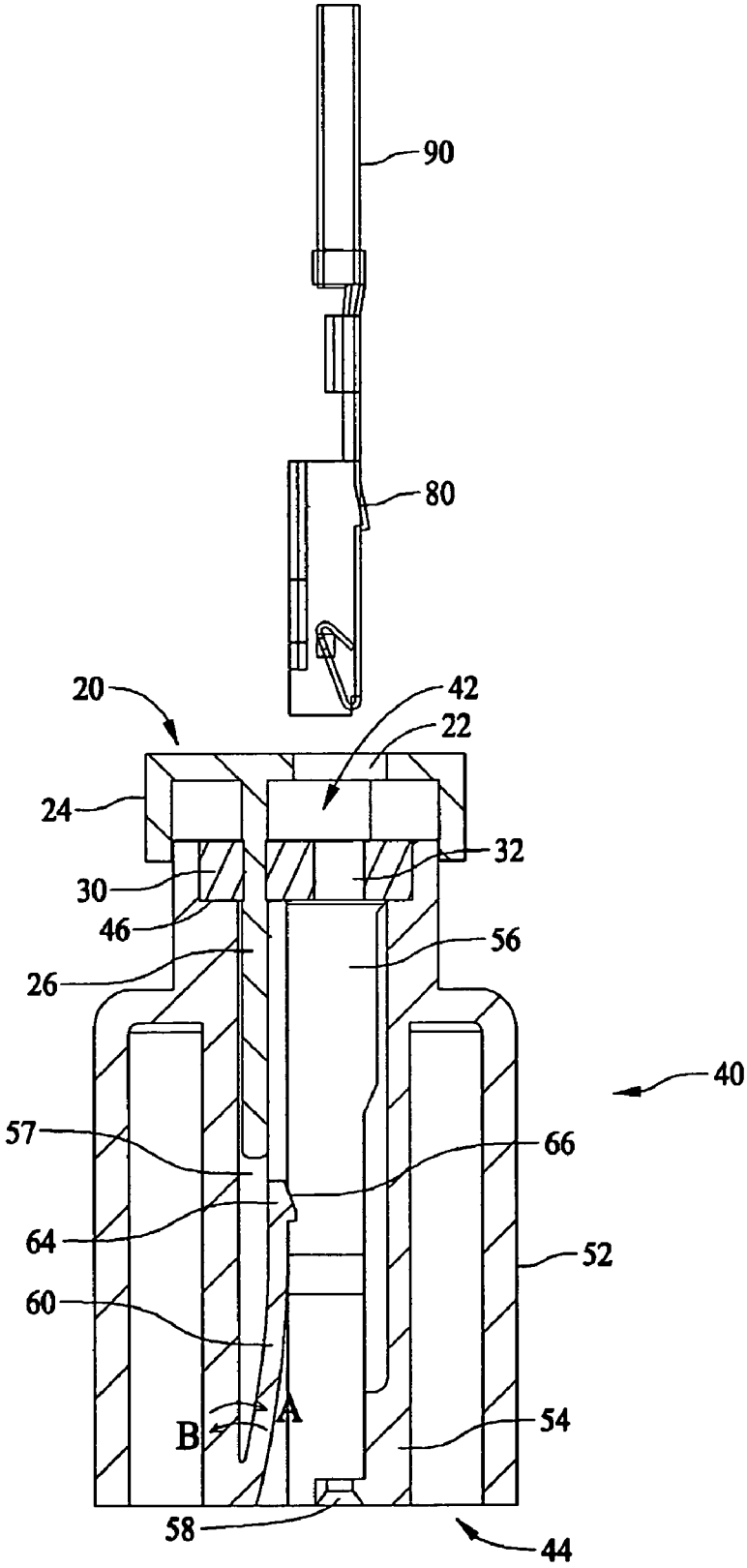
FIG. 4 is a side cross-sectional view of the connector of FIG. 1 with the cover in the initial staged position to receive an electrical contact.

FIG. 4 illustrates the connector 10 in an initial staged condition ready to receive a terminal contact 80 which is crimped to a wire 90. In the initial staged condition, the cover 20 is positioned partially, but not fully, over the wire receiving end 42 of the housing 40. The seal 30 is seated in the seal cavity 46 of the housing 40 and the TPA 26 extends through the seal 30 partially but not fully, into the TPA channel 57 of the connector body 54. When in the initial stage, the TPA 26, being joined to the cover 20, is remote from the terminal retention member 60 such that the contact latch 64 is free to move in to the TPA channel 57 with deflection of the terminal retention member 60 in the direction of arrow B when the contact 80 encounters the beveled surface 66 of the contact latch 64.

Figure 5:
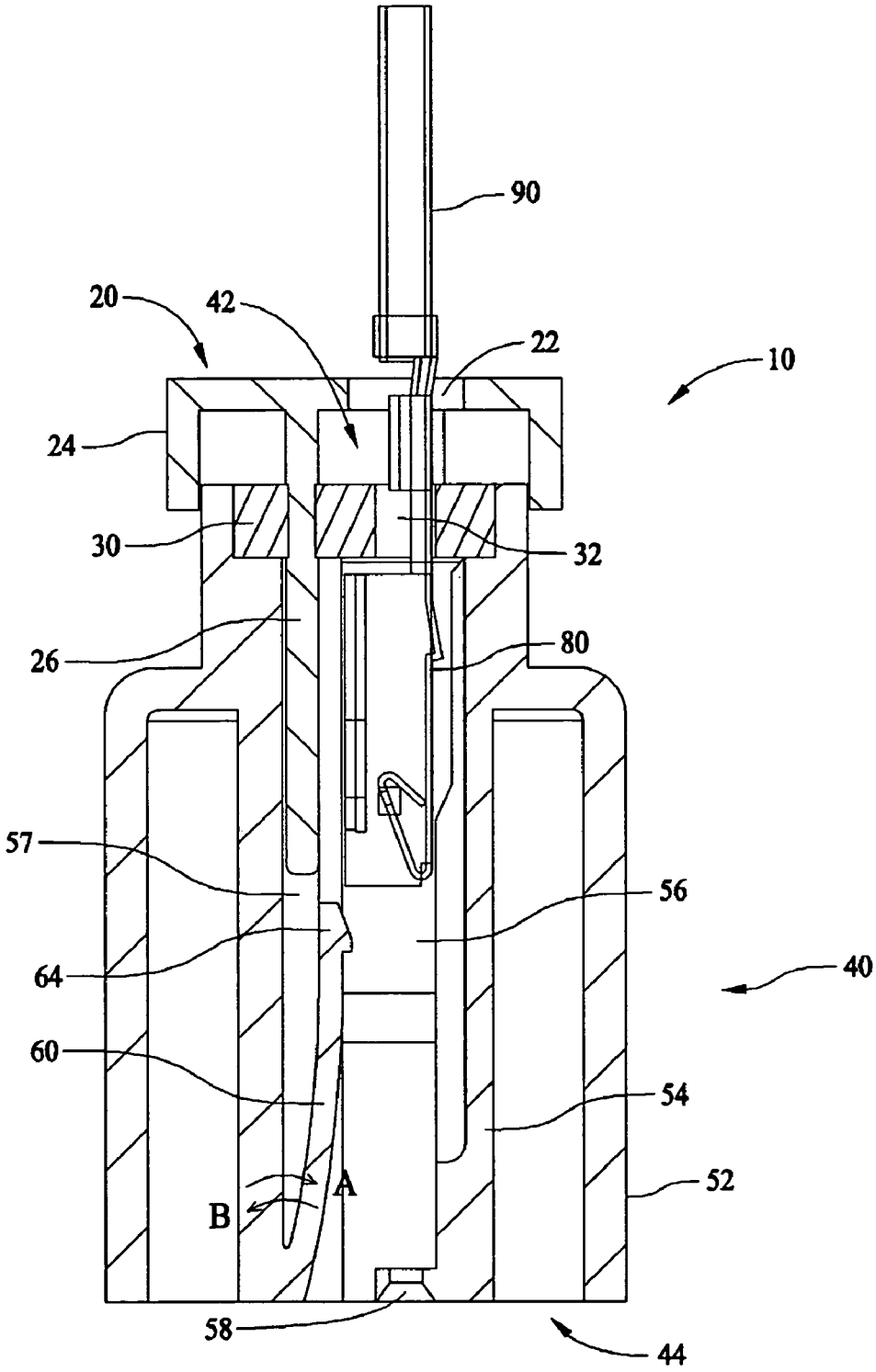
FIG. 5 is a side cross-sectional view of the connector of FIG. 1 with a partially inserted contact.

FIG. 5 illustrates the connector 10 with a partially inserted contact 80. In FIG. 5, the contact 80 has passed through contact opening 22 in the cover 20 as well as the contact opening 32 in the seal 30 and is positioned within the contact cavity 56 of the connector body 54. In the position illustrated in FIG. 5, the contact 80 has not yet engaged the contact latch 64.

Figure 6:
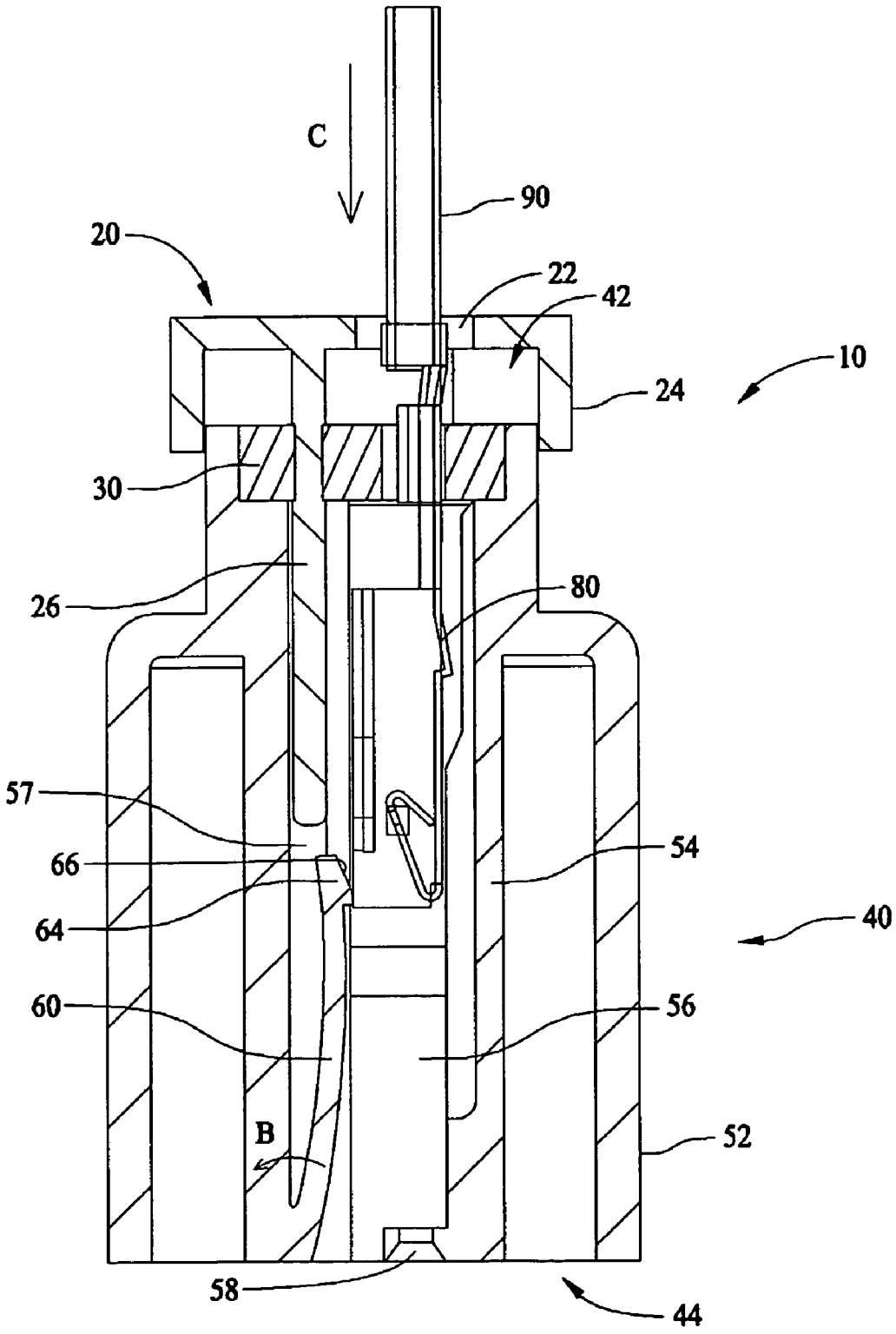
FIG. 6 is a side cross-sectional view of the connector of FIG. 1 with the contact partially engaging a terminal retention member.

FIG. 6 illustrates the staged connector 10 with a contact 80 sufficiently inserted into the contact cavity 56 to engage the contact latch 64 of the terminal retention member 60. In FIG. 6, the contact 80 has engaged the beveled surface 66 of the contact latch 64 and deflected the contact latch 64 into the TPA channel 57 and into the path of the TPA element 26. The terminal retention member 60 is deflected in the direction of arrow B as the contact 80 is inserted past the contact latch 64 in the direction of arrow C. In this position, the path of the TPA element 26 is obstructed by the contact latch 64 so that the seating of the cover 20 is inhibited, thus affording the terminal position assurance feature of the connector 10. The contact latch 64 will remain in the TPA channel 57 until the contact 80 is fully inserted.

Figure 7:
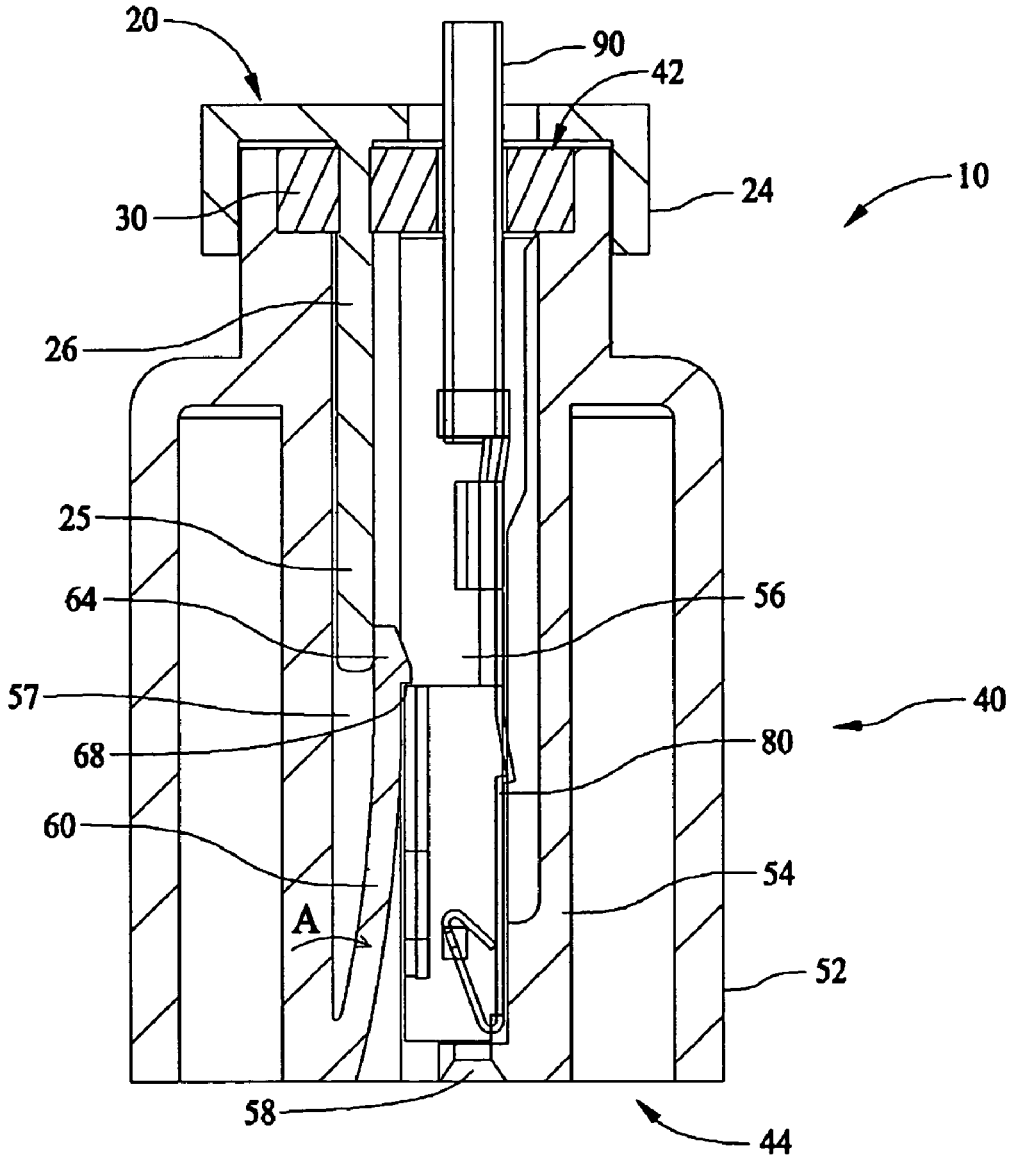
FIG. 7 is a side cross-sectional view of a connector with a contact fully loaded and the cover in the final seated condition.

FIG. 7 illustrates the connector 10 in a final seated condition. As illustrated in FIG. 7, the contact 80 is fully seated within the contact cavity 56 of the connector body 54 such that the contact latch 64 fits behind the contact 80. The terminal retention member 60 moves back in the direction of Arrow A such that the contact latch 64 is returned to its biased position extending into contact cavity 56. The cover 20 is moved to a seated position with the outer end 25 of the TPA element 26 extended sufficiently into TPA channel 57 to rest behind and directly adjacent the terminal retention member 60 in order to inhibit movement of the contact latch 64 out of the contact cavity 56. The seal 30 envelopes the wire 90 and the TPA 26 to seal the wire receiving end 42 of the connector 10 thus providing a sealed connector. The contact 80 is retained in the contact cavity 56 by the latch face 68 of the contact latch 64, which inhibits the withdrawal of the contact 80. With the installation of the contact 80 into connector 10 completed, the contact 80 can now receive a terminal (not shown) from a mating connector or electrical device through the terminal opening 58 at the mating face 44 of the connector 10.

Optionally, the terminal 80 need not be loaded through the cover 20. Instead the terminal 80 may be loaded through the connector body 54 or around the cover 20 or through the mating end 44.

The embodiments thus described provide a sealed connector having a seal, cover, and TPA combined in a single integral unit. The connector is suited for applications requiring sealed and serviceable connections such as, for example, fuel injection or other engine compartment applications or vehicle sensor system applications. The connector may, of course, also be used in applications not requiring a sealed connector.

While the invention has been described in terms of various specific embodiments, those skilled in the art will recognize that the invention can be practiced with modification within the spirit and scope of the claims.

What is claimed is:

1. An electrical connector comprising:

a housing having a mating end and a wiring receiving end, said wire receiving end being configured to receive a pair of terminals;

a pair of contact cavities formed in said housing;

a pair of TPA channels formed in said housing separate from and adjacent to corresponding said contact cavities, wherein said contact cavities extend from said mating end to said wire receiving end, said housing having a pair of retention beams formed separate from one another and integral with said housing and extending from said mating end towards said wire receiving end; and a cover provided on said wire receiving end of said housing, said cover including a pair of separate terminal position assurance (TPA) elements, each of said TPA elements associated with a respective one of said pair of terminals, said TPA elements extending from said cover through said wire receiving end into said housing, each said TPA element engaging corresponding separate said housing retention beams to prevent movement of said cover to a closed position until the associated terminal is fully loaded through said wire receiving end of said housing.

2. The connector of claim 1, further comprising a seal held between said housing and cover when said cover is in said closed position.

3. The connector of claim 1, wherein said wire receiving end includes a seal cavity facing said cover, said cavity receiving a seal configured to be sealably secured to at least one of a wire and terminal.

4. The connector of claim 1, wherein said retention beams are associated with each terminal and configured to retain the associated terminal in said housing when the associated terminal is fully loaded, said TPA elements inhibiting movement of said retention beams when said cover is in said closed position.

5. The connector of claim 1, wherein said retention beams have contact latches directed toward said wire receiving end, said retention beams being deflectable when the terminals are loaded.

6. The connector of claim 1, wherein said contact cavities are configured to receive terminals, said retention beams having terminal retention latches biased into an interfering relation with said contact cavities, said terminal retention latches being deflected outward away from said contact cavities as terminals are loaded.

7. The connector of claim 1, wherein said contact cavities extend along a terminal loading axis and said retention beams are deflectable transverse to said terminal loading axis, said TPA elements extending parallel to said terminal loading axis and engaging respective ones of said retention beams.

8. The connector of claim 1, wherein said mating end opposes said wire receiving end.

9. The connector of claim 1, wherein said cover includes a rim secured over a perimeter of said wire receiving end of said housing.

10. An electrical connector comprising:

a housing including a body having a mating end and a wire receiving end, said body having a pair of contact cavities configured to receive a pair of terminals through said wire receiving end and a and having a pair of TPA channels formed separate from and adjacent to corresponding said contact cavities;

a pair of retention beams formed separate from one another and integral with said body and each said retention beam being configured to retain a corresponding terminal in a respective one of said contact cavities; and a cover provided on said wire receiving end of said body, said cover including a pair of terminal position assurance (TPA) elements, each of said TPA elements associated with a respective one of said pair of terminals, said TPA elements extending from said cover through said wire receiving end into said body, each said TPA element engaging corresponding separate said retention beams to prevent movement of said cover to a closed position until the associated terminal and wire are fully loaded through said wire receiving end.

11. The connector of claim 10, further comprising a seal held between said body and said cover when said cover is in said closed position.

12. The connector of claim 10, wherein said housing further includes a shroud joined to said body proximate said wire receiving end and covering said body.

13. The connector of claim 10, wherein said wire receiving end of said body includes a seal cavity facing said cover, said cavity receiving a seal configured to be sealably secured to at least one of a wire and terminal.

14. The connector of claim 10, wherein said TPA elements inhibit movement of said terminal retention beams when said cover is in said closed position.

15. The connector of claim 10, wherein said retention beams extend from said mating end towards said wire receiving end.

16. The connector of claim 10, wherein said retention beams are biased into an interfering relation with a respective one of said contact cavities, said retention beams being deflected outward away from said contact cavities as terminals are loaded.

17. The connector of claim 10, wherein said contact cavities extend along a terminal loading axis and said retention beams are deflectable transverse to said terminal loading axis, said TPA elements extending parallel to said terminal loading axis and engaging said retention beams.

18. The connector of claim 10, wherein each said retention element beams includes a contact latch directed towards said wire receiving end, said contact latch being deflected when a terminal is loaded.

19. The connector of claim 10, wherein said mating end opposes said wire receiving end.

* * * * *